US007540290B2

(12) United States Patent
Chou

(10) Patent No.: US 7,540,290 B2
(45) Date of Patent: Jun. 2, 2009

(54) BARRETTE

(75) Inventor: Wei-Cheng Chou, Wu-Ku Hsiang (TW)

(73) Assignee: Kuo-Hua Chou, Taipei County (TW)

( * ) Notice: Subject to any disclaimer, the term of this patent is extended or adjusted under 35 U.S.C. 154(b) by 335 days.

(21) Appl. No.: 11/652,577

(22) Filed: Jan. 12, 2007

(65) Prior Publication Data

US 2007/0163616 A1 Jul. 19, 2007

(30) Foreign Application Priority Data

Jan. 17, 2006 (CN) ..... 2006 2 0001218 U

(51) Int. Cl.
*A45D 8/22* (2006.01)
*A45D 8/20* (2006.01)

(52) U.S. Cl. ..... 132/278; 132/277

(58) Field of Classification Search ..... 132/278, 132/277, 279, 276, 273, 275
See application file for complete search history.

(56) References Cited

U.S. PATENT DOCUMENTS 5,365,955 A * 11/1994 Desgroux et al. ..... 132/279
5,445,170 A * 8/1995 Yasuda ..... 132/279
6,311,700 B1 * 11/2001 Yeh ..... 132/279
6,378,532 B1 * 4/2002 Chou et al. ..... 132/279

* cited by examiner

*Primary Examiner*—Robyn Doan
(74) *Attorney, Agent, or Firm*—Rosenberg, Klein & Lee

(57) ABSTRACT

A barrette includes an arched base member, an upper clamping member, which has one end pivoted to one end of the base member and a longitudinal rail at one side, and a lower clamping member, which has a first end pivoted to the base member adjacent to the pivot joint between the base member and the upper clamping member, a second end slidably coupled to the longitudinal rail of the upper clamping member, a longitudinal sliding slot, and an arched clamping strip that has one end fixedly connected to one end of the longitudinal sliding slot and the other end inserted through and movable along the longitudinal sliding slot.

2 Claims, 7 Drawing Sheets

BARRETTE

BACKGROUND OF THE INVENTION

1. Field of the Invention

The present invention relates to hairstyling implements and more particularly, to a barrette, which automatically adjusts the clamping force subject to the amount of hair clamped.

2. Description of the Related Art

A conventional barrette is known comprising a base member, an upper clamping member, which has one end pivoted to one end of the base member and the other end detachably connectable to the other end of the base member, and a lower clamping member, which has one end pivoted to the base member and the other end slidably coupled to the upper clamping member. According to this design, the clamping force of the upper clamping member and the lower clamping member is not adjustable subject to the amount of hair to be clamped. When clamping a big amount of hair with this structure of barrette, the excessive high clamping force of the barrette may damage hair.

SUMMARY OF THE INVENTION

The present invention has been accomplished under the circumstances in view. It is the main object of the present invention to provide a barrette, which is easy to operate. It is another object of the present invention to provide a barrette, which automatically adjusts the clamping force subject to the amount of hair clamped.

To achieve these and other objects of the present invention, the barrette comprises a base member, a lower clamping member, and an upper clamping member. The base member has a first end, a second end, two knuckles at the first end, two upright lugs near the knuckles, two finger grips at the second end, and a hook at one finger grip. The lower clamping member has two pivot rods aligned at a first end thereof and respectively pivotally coupled to the upright lugs of the base member, and an engagement portion at a second end thereof for securing to the hook of the base member. The upper clamping member has a first end pivotally connected to the knuckles of the base member. Further, the upper clamping member has a longitudinal rail at one side thereof. The lower clamping member has a longitudinal sliding slot, a smoothly arched clamping strip for clamping a user's hair on the base member. The smoothly arched clamping strip has a fixed end fixedly connected to one end of the longitudinal sliding slot, a free end inserted through the longitudinal sliding slot, and a transversely extending stop rod disposed at the free end and stopped at one side of the lower clamping member for guiding movement of the free end of the smoothly arched clamping strip along the longitudinal sliding slot, and a coupling lug coupled to and movable along the longitudinal rail of the upper clamping member.

DETAILED DESCRIPTION OF THE PREFERRED EMBODIMENT

Figure 1:
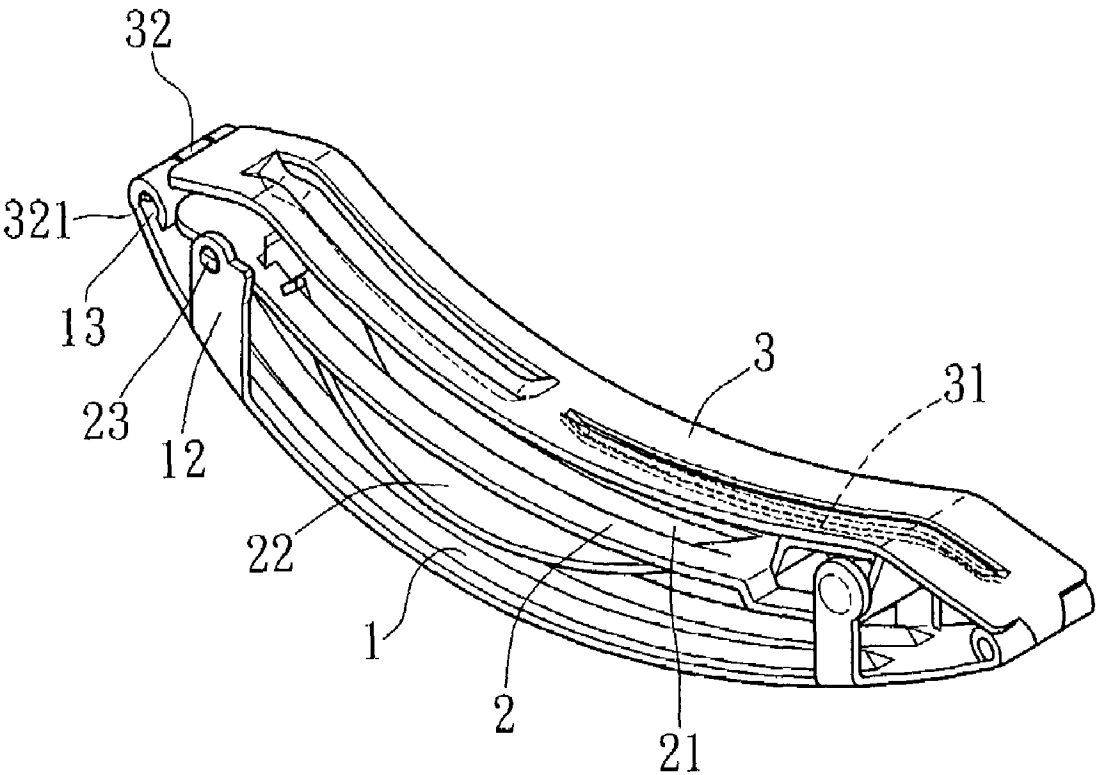
FIG. 1 is an elevational assembly view of a barrette according to the present invention.
Figure 2:
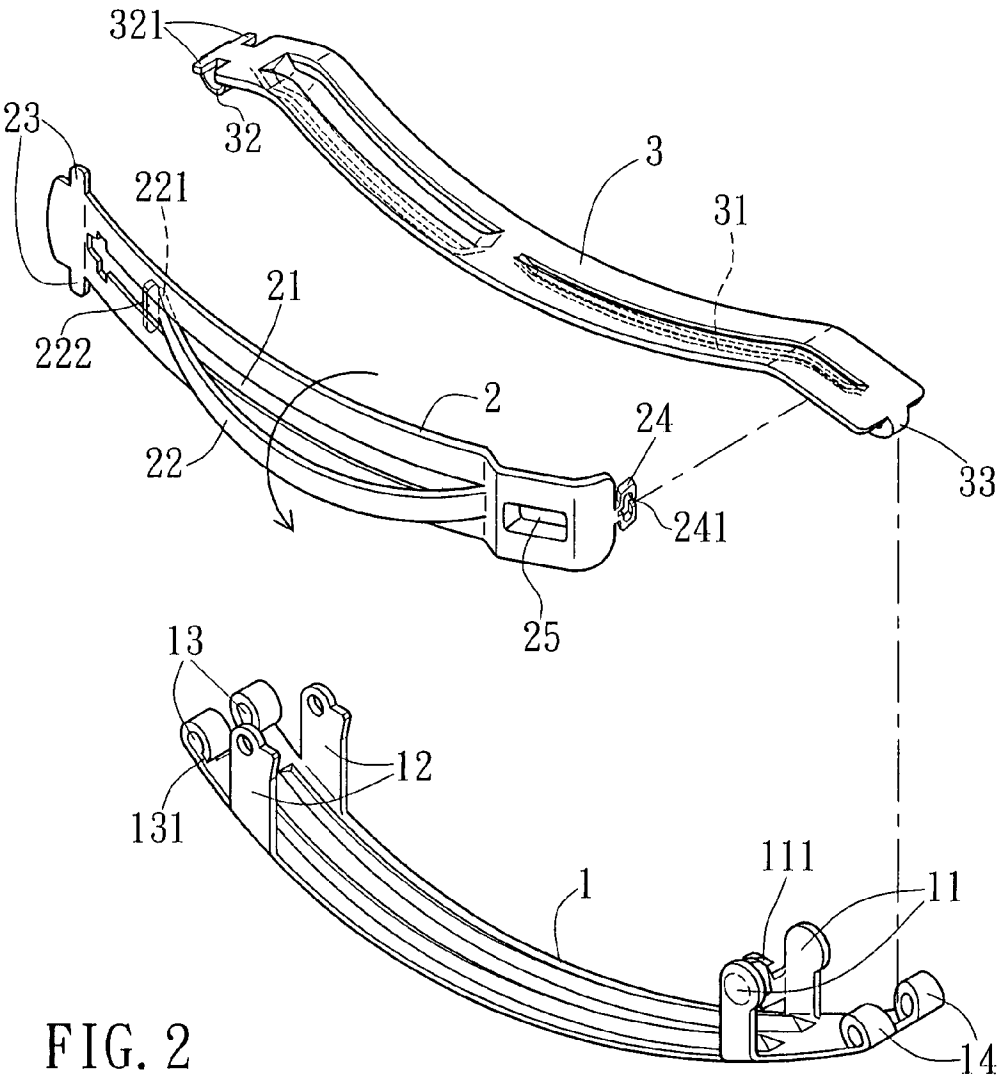
FIG. 2 is an exploded view of the barrette according to the present invention.

Referring to FIGS. 1 and 2, a barrette in accordance with the present invention is shown comprised of a narrow, elongated smoothly arched base member 1, a lower clamping member 2, and an upper clamping member 3.

Figure 6:
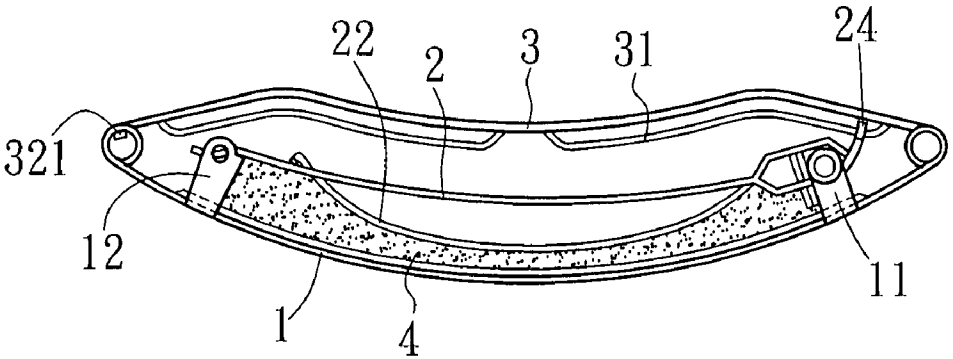
FIG. 6 is a schematic drawing showing an application example of the barrette.
Figure 7:
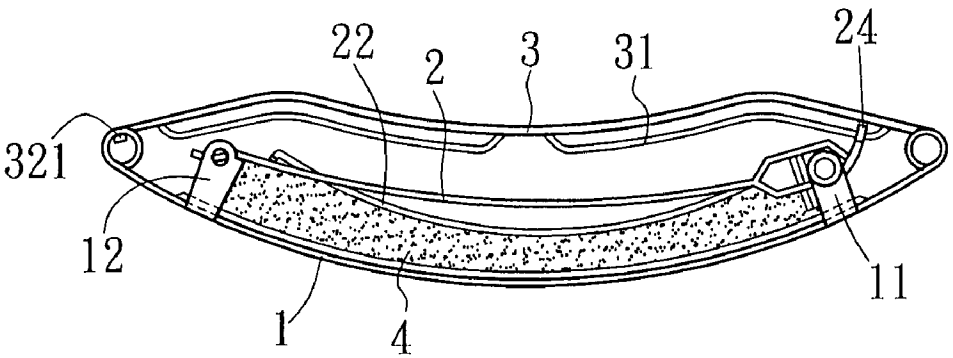
FIG. 7 is a schematic drawing showing another application example of the barrette.

The lower clamping member 2 has a longitudinal sliding slot 21, and an arched clamping strip 22. The arched clamping strip 22 has a fixed end fixedly connected to one end of the longitudinal sliding slot 21, and a free end 221 inserted through the longitudinal sliding slot 21 and terminating in a transversely extending stop rod 222 that has a width greater than the width of the longitudinal sliding slot 21 and is stopped at the top side of the lower clamping member 2 opposite to the bottom base member 1. When the lower clamping member 2 is closed on the base member 1, the arched clamping strip 22 is pressed on hair 4 against the base member 1. The transversely extending stop rod 222 of the free end 221 of the arched clamping strip 22 is moved along the longitudinal sliding slot 21 to adjust the applied pressure to clamped hair 4 against the base member 1 subject to the amount of clamped hair 4 (see FIGS. 6 and 7).

Figure 3:
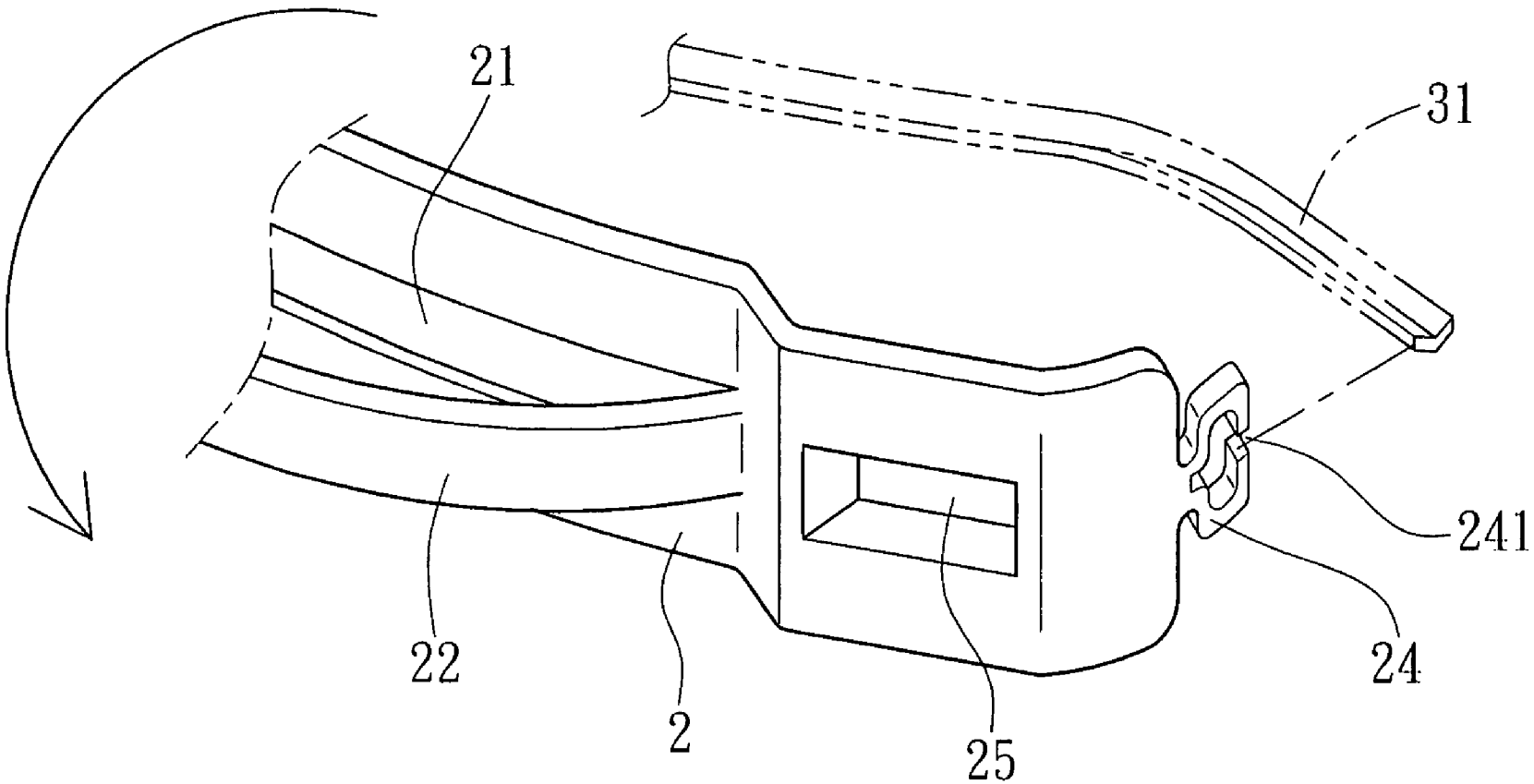
FIG. 3 is a schematic drawing illustrating coupling action between the coupling lug of the lower clamping member and the longitudinal rail of the upper clamping member according to the present invention.
Figure 4:
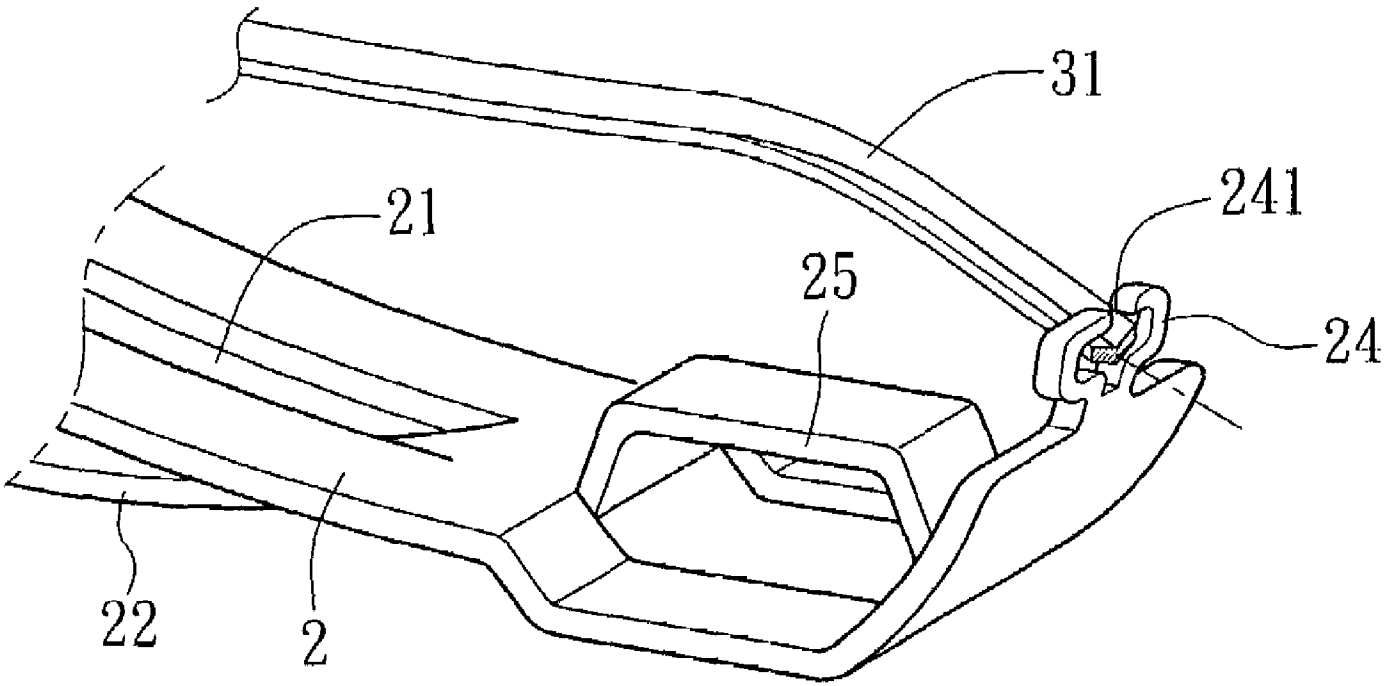
FIG. 4 corresponds to FIG. 3, showing the coupling lug coupled to the longitudinal rail.
Figure 8:
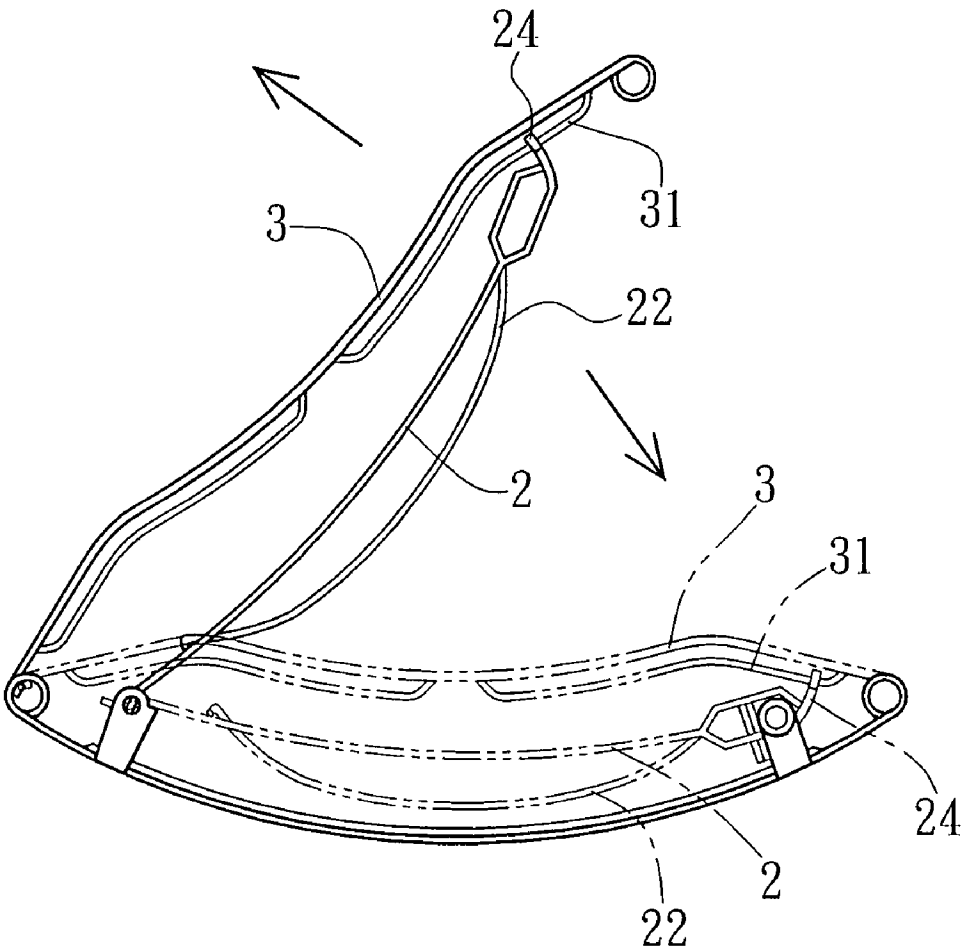
FIG. 8 is a schematic drawing illustrating the lower clamping member opened with the upper clamping member from the base member according to the present invention.

The lower clamping member 2 further has two pivot rods 23 aligned at its one end (the first end) and respectively pivotally connected to two upright lugs 12 near one end (the first end) of the base member 1, a coupling lug 24 extended from its other end (the second end) slidably coupled to a longitudinal rail 31 of the upper clamping member 3, and an engagement portion 25 disposed near the coupling lug 24 for securing to a hook 111 at one of two finger grips 11 near the other end (second end) of the base member 1. The longitudinal rail 31 has a T-shaped cross section. The coupling lug 24 has a T-shaped opening 241 by which the coupling lug 24 is attached to the longitudinal rail 31 of the upper clamping member 3 at right angles and then turned relative to the upper clamping member 3 through 90° (see FIGS. 3 and 4). After coupling of the coupling lug 24 to the longitudinal rail 31 of the upper clamping member 3, the coupling lug 24 is movable along the longitudinal rail 31 (see FIG. 8).

Figure 5:
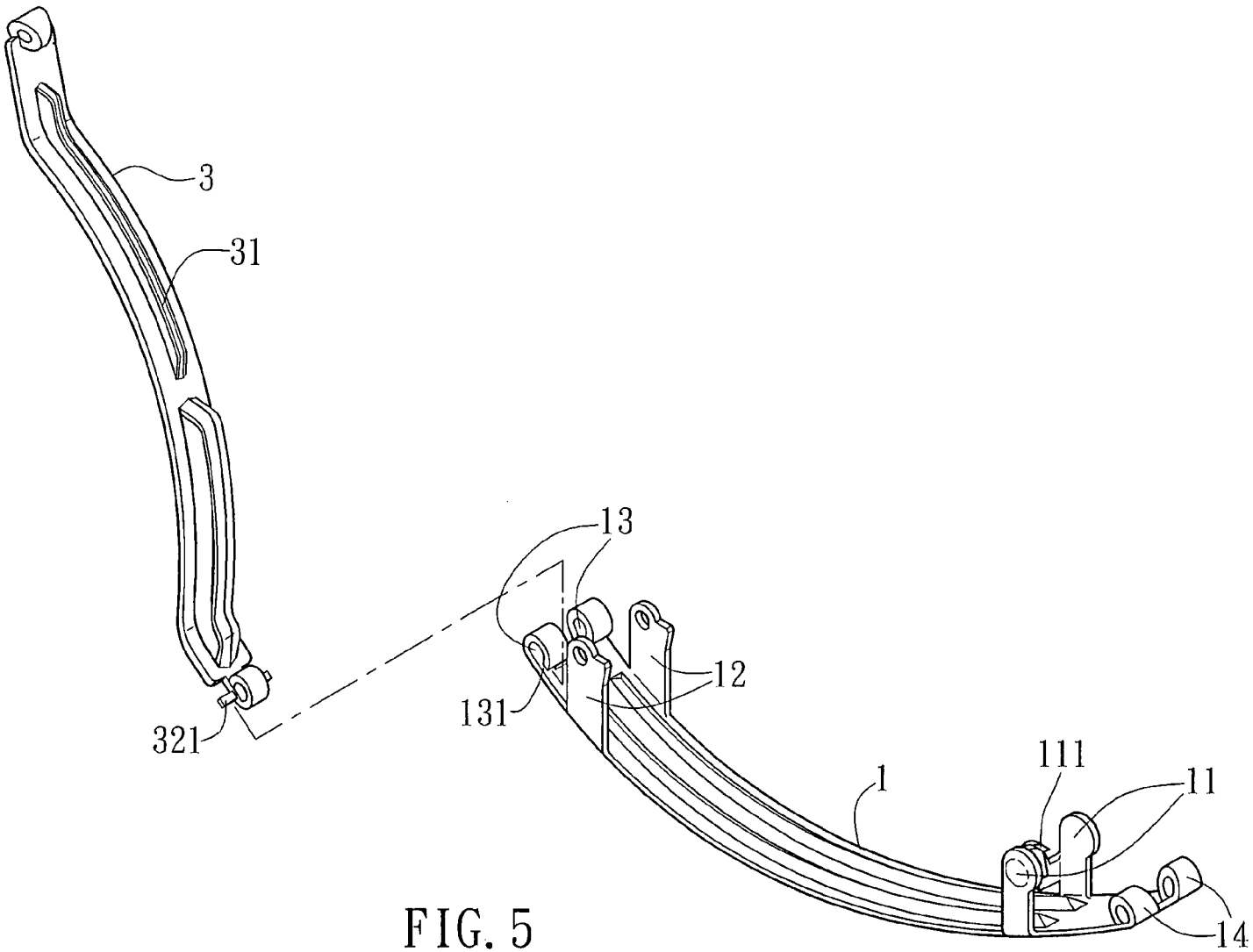
FIG. 5 is an exploded view of a part of the present invention, showing the mounting arrangement between the base member and the upper clamping member.

The upper clamping member 3 has a knuckle 32 at its one end (the first end), two pivot rods 321 eccentrically extended from two sides of the knuckle 32, and a friction barrel 33 at its other end (the second end). The base member 1 further has two knuckles 13 aligned at the first end, and two friction barrels 14 aligned at the second end. The knuckles 13 each have an opening 131. During installation, the upper clamping member 3 is turned upside down (see FIG. 5), and then the pivot rods 321 of the upper clamping member 3 are respectively inserted through the openings 131 into the knuckles 13, and then the upper clamping member 3 is returned to its normal position to have the knuckle 32 be set in between the two knuckles 13 of the base member 1 (see FIG. 6). When the upper clamping member 3 is closed on the lower clamping member 2 and the base member 1, the friction barrel 33 is set into the gap between the two friction barrels 14 of the base member 1 and secured thereto by friction resistance (see FIG. 1).

A prototype of barrette has been constructed with the features of FIGS. 1~8. The barrette functions smoothly to provide all the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A barrette comprising:

a base member, said base member having a first end, a second end, two knuckles at the first end, two upright lugs near the knuckles, two finger grips at the second end, and a hook at one of said finger grips;

a lower clamping member, said lower clamping member having two pivot rods aligned at a first end thereof and respectively pivotally coupled to the upright lugs of said base member, and an engagement portion at a second end thereof for securing to the hook of said base member; and an upper clamping member, said upper clamping member having a first end pivotally connected to the knuckles of said base member;

wherein:

said upper clamping member has a longitudinal rail at one side thereof;

said lower clamping member has a longitudinal sliding slot, a smoothly arched clamping strip for clamping an user's hair on said base member, said smoothly arched clamping strip having a fixed end fixedly connected to one end of said longitudinal sliding slot, a free end inserted through said longitudinal sliding slot, and a transversely extending stop rod disposed at the free end and stopped at one side of said lower clamping member for guiding movement of the free end of said smoothly arched clamping strip along said longitudinal sliding slot, and a coupling lug coupled to and movable along said longitudinal rail of said upper clamping member.

2. The barrette as claimed in claim 1, wherein said longitudinal rail has a T-shaped cross section; said coupling lug of said upper clamping member has a T-shaped opening fitting the T-shaped cross section of said longitudinal rail.

* * * * *